US010480470B2

(12) United States Patent
Graham et al.

(10) Patent No.: US 10,480,470 B2
(45) Date of Patent: Nov. 19, 2019

(54) HIGH PRESSURE FLUID CONNECTION

(71) Applicant: DELPHI TECHNOLOGIES IP LIMITED, St. Michael (BB)

(72) Inventors: Mark S. Graham, Bristol (GB); Anthony T. Harcombe, Richmond (GB)

(73) Assignee: DELPHI TECHNOLOGIES IP LIMITED (BB)

( * ) Notice: Subject to any disclaimer, the term of this patent is extended or adjusted under 35 U.S.C. 154(b) by 432 days.

(21) Appl. No.: 14/902,958

(22) PCT Filed: Jun. 25, 2014

(86) PCT No.: PCT/EP2014/063416
§ 371 (c)(1),
(2) Date: Mar. 29, 2016

(87) PCT Pub. No.: WO2015/000765
PCT Pub. Date: Jan. 8, 2015

(65) Prior Publication Data

US 2016/0290300 A1 Oct. 6, 2016

(30) Foreign Application Priority Data

Jul. 5, 2013 (EP) ..... 13175394

(51) Int. Cl.
*F02M 61/14* (2006.01)
*F02M 55/00* (2006.01)
*F02M 55/02* (2006.01)

(52) U.S. Cl.
CPC ..... *F02M 61/14* (2013.01); *F02M 55/005* (2013.01); *F02M 55/02* (2013.01); *F02M 2200/803* (2013.01); *F02M 2200/855* (2013.01)

(58) Field of Classification Search
CPC ..... F02M 61/14; F02M 55/005; F02M 55/02; F02M 2200/803; F02M 2200/855
USPC ..... 123/470
See application file for complete search history.

(56) References Cited

U.S. PATENT DOCUMENTS 4,799,444 A * 1/1989 Lisowski ..... F16B 2/06 114/221 R
5,071,172 A * 12/1991 Gross ..... F16L 39/00 285/124.4
5,566,658 A * 10/1996 Edwards ..... F02F 1/4214 123/470
5,765,534 A 6/1998 Brown et al.
(Continued)

FOREIGN PATENT DOCUMENTS

DE 30 10 328 A1 9/1981
DE 3010328 * 9/1981 ..... F02M 55/002
(Continued)

OTHER PUBLICATIONS

International Search Report dated Jul. 28, 2014.

*Primary Examiner* — Hung Q Nguyen
*Assistant Examiner* — Anthony Donald Taylor, Jr.
(74) *Attorney, Agent, or Firm* — Joshua M. Haines

(57) ABSTRACT

A fuel injection system for an internal combustion engine includes an injector having a first orifice to which is tightly connected a pipe having a matching first orifice. Both orifices are surrounded with peripheral smooth surfaces that are complementary surfaces sealingly pressed against each other by a clamping plate.

1 Claim, 4 Drawing Sheets

(56) References Cited

U.S. PATENT DOCUMENTS 5,899,190 A * 5/1999 Nakagomi ..... F02M 61/14 123/470
6,152,112 A * 11/2000 Coppola ..... F02M 55/005 123/468
6,196,194 B1 * 3/2001 Mitchell ..... F02M 61/14 123/470
6,269,798 B1 * 8/2001 Takahashi ..... F02M 61/14 123/469
6,431,152 B1 * 8/2002 Estacio ..... F02M 61/14 123/470
6,745,752 B1 * 6/2004 Jensen ..... B25B 27/0028 123/470
6,769,409 B2 * 8/2004 Evancik ..... F02M 61/14 123/463
6,802,539 B2 * 10/2004 Cooke ..... F02M 55/005 123/468
6,863,053 B2 * 3/2005 Suzuki ..... F02M 55/025 123/456
7,249,593 B2 * 7/2007 Ricco ..... F02M 47/027 123/456
7,261,246 B2 * 8/2007 Krause ..... F02M 61/14 239/533.1
7,334,572 B1 * 2/2008 Diggs ..... F02F 7/006 123/195 C
7,347,189 B2 * 3/2008 Anello ..... F02M 61/14 123/470
7,588,016 B2 * 9/2009 Pauer ..... F02M 51/0603 123/456
8,336,524 B2 * 12/2012 Ganser ..... F02M 55/025 123/456
8,522,754 B2 * 9/2013 Lazich ..... F02M 61/14 123/470
8,646,434 B2 * 2/2014 Harvey ..... F02M 55/005 123/456
2007/0246016 A1 10/2007 Scheffel et al.
2010/0012093 A1 * 1/2010 Pepperine ..... F02M 55/004 123/470
2011/0315117 A1 12/2011 Gerstner et al.
2012/0060797 A1 * 3/2012 Engquist ..... B22F 3/1017 123/470
2015/0330347 A1 * 11/2015 Pohlmann ..... F02M 61/14 239/408

FOREIGN PATENT DOCUMENTS

DE 10 2006 059690 A1 6/2008
DE 10 2008 017227 A1 10/2009
DE 102008017227 * 10/2009 ..... F02M 55/005
EP 1 079 100 A2 2/2001
GB 362 773 A 12/1931
JP 2006316741 A 11/2006
JP 2010174656 A 8/2010
WO 2011085858 A1 7/2011
WO WO2011085858 * 7/2011 ..... F02M 55/02

* cited by examiner

HIGH PRESSURE FLUID CONNECTION

CROSS REFERENCE TO RELATED APPLICATIONS

This application is a national stage application under 35 USC 371 of PCT Application No. PCT/EP2014/063416 having an international filing date of Jun. 25, 2014, which is designated in the United States and which claimed the benefit of EP Patent Application No. 13175394.9 filed on Jul. 5, 2013, the entire disclosures each are hereby incorporated by reference in their entirety.

TECHNICAL FIELD

High pressure fluid systems comprise several devices tightly interconnected by pipes. Known connecting systems have been developed overtime such as flange and threaded nut, threaded pipes and others. In the confined environment of a vehicle engine, the fuel injection system comprises multiple of these connections that consequently are not easily accessible for assembling or servicing.

BACKGROUND OF THE INVENTION

High pressure fluid systems comprise several devices tightly interconnected by pipes. Known connecting systems have been developed overtime such as flange and threaded nut, threaded pipes and others. In the confined environment of a vehicle engine, the fuel injection system comprises multiple of these connections that consequently are not easily accessible for assembling or servicing.

SUMMARY OF THE INVENTION

Accordingly, it is an object of the present invention to provide a fuel injection system for an internal combustion engine. The system comprises an injector having a first orifice to which is tightly connected a pipe having a matching first orifice. Both orifices are surrounded with peripheral smooth surfaces that are complementary surfaces sealingly pressed against each other by a screw clamping plate.

The injector has a connection head where are arranged its first orifice and a second orifice. Both orifices join a common internal volume. The injection system further comprises an intermediate pipe having a matching orifice tightly connected to the injector's second orifice. Both said orifices are surrounded with peripheral smooth surfaces that are complementary surfaces sealingly pressed against each other by the clamping plate.

The orifices of said intermediate pipe are arranged at the extremities of said intermediate pipe. The system further comprises a second injector which first orifice is tightly connected to said another orifice of said intermediate pipe so that the first and the second injectors are connected.

More particularly, the system comprises at least three injectors connected by a plurality of intermediate pipes. The assembly extends from a first injector to a last injector and, the system further comprises a high pressure pump having an outlet orifice tightly connected by an intermediate pipes to the first orifice of said first injector.

Also, all smooth surfaces surrounding orifices are surfaces of revolution, the axis of each surface being the axis of the surrounded orifice, such as portion of cones or of sphere or are ovoid or flat discs.

Furthermore, the clamping plate has a fork-like portion extending from a lower surface to an upper surface of said clamping plate. The lower surface is arranged to face the head of the injector and the pipe is provided with a collar. The pipe is arranged in the fork with the collar in abutment against the lower face of the clamping plate, a screw being tightened to solicit the clamping plate toward the injector, the tightening force being transmitted to the collar so that the smooth surfaces of the pipe and of the injector are sealingly pressed against each other.

The clamping plate may have a second fork-like portion so that the injector's first and second orifices are sealingly connected to respective pipes.

The clamping plate has a through hole in which passes the screw, the head of the screw being in abutment against the upper surface of the clamping plate and its threaded portion being threaded into the head of the injector. The tightening force maintains the pipe in tightly connection with the injector.

More precisely, the clamping plate has a through hole wherein passes the screw, the head of the screw is in abutment against the upper surface of the clamping plate and its threaded portion being threaded into the engine block. The tightening force maintains the pipe in tightly connection with the injector and the injector in place on the engine.

The clamping plate may have a second through hole wherein passes a second screw, the head of the second screw being in abutment against the upper surface of the clamping plate and its threaded portion being threaded as well into the engine block. The fork-like is centrally arranged and the two screws are diametrically opposed from the fork-like so to provide balanced forces to tightly connect the pipe onto the injector.

In yet another embodiment, the pipe is cylindrical and is provided with a radial orifice extending through its wall, the complementary smooth surfaces being the outer cylindrical surface of the pipe and a matching surface of a groove. The groove is arranged on the top surface of the head of the injector.

This connections arrangement enable to assemble a system comprising a plurality of injectors connected to a single pipe provided with a plurality of radial orifices each of which being tightly connected to the first orifice of an injector.

More particularly the pipe can be engaged between a lower surface of the clamping plate and the head of the injector, a screw being tightened to force the clamping plate toward the injector so transmitting a radial tightening force to the pipe. Consequently, the smooth cylindrical surfaces of the pipe and of the injector are sealingly pressed against each other.

The screw is threaded on the head of the injector so that the clamping plate and the injector are pulled toward each other, the pipe between them being fixed by a radial compression force.

Also, the head of the injector and an extremity of the clamping plate may be engaged both having complementary hook-like shapes. The screw is tightened at an extremity of the clamping plate opposed to the hook, so that the pipe between the clamping plate and the injector's head is fixed by a radial compression force.

BRIEF DESCRIPTION OF THE DRAWINGS

The present invention is now described by way of example with reference to the accompanying drawings in which.

DESCRIPTION OF THE PREFERRED EMBODIMENTS

Figure 1:
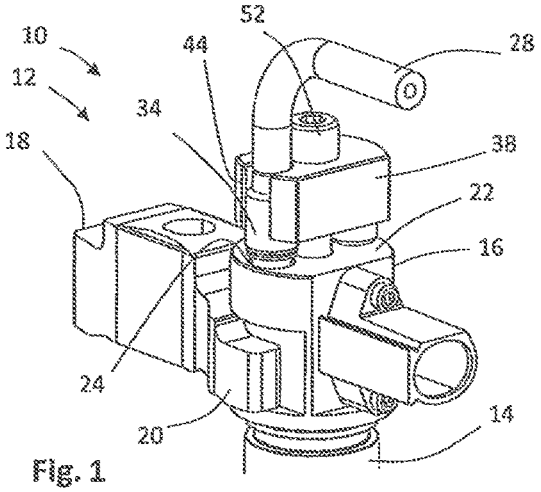
FIG. 1 is a general view of the connection of a pipe on an injector as per a first embodiment.

In the following description, similar elements will be designated with the same reference numbers.

Although the invention hereafter disclosed can be implemented in any high pressure fluid system, it has first been thought as part of a diesel engine 10 fuel injection system 12 wherein the fuel pressure exceeds 2000 bars. Therefore this description is based on such injection system 12 without any intent to limit the scope of the invention.

A fuel injector 14 has an elongated shape extending along a main axis A from a top head 16 to an injection nozzle. The injector 14 is positioned in a well provided in the engine block wherein it is fixed thanks to a fixing block 18 screwed onto the engine block. The fixing block 18 has an attachment feature 20, similar to a pair of clamp, receiving the injector's head 16 and, the screwing force exercises onto the injector 14 a fixing axial force.

A first embodiment of the invention is now described with reference to FIGS. 1 and 2. On this first one-pipe embodiment, the top face 22 of the head 16 opens a first orifice 24 which in the vicinity of the top face 22 enlarges in a female conical surface 26. In this single-pipe embodiment, the first orifice 24 is an inlet wherein the high pressure fuel enters the injector. A pipe 28, provided at its extremity with a corresponding first orifice 30 surrounded by a male conical surface 32 is in complementary engagement with the head's first orifice 24. A tubular sleeve 34 arranged around the pipe 28 is in abutment against the base of the male cone that forms a transversal surface 36 such as a collar.

A clamping plate 38, arranged on the head's top face 22, has opposite upper 40 and lower 42 faces joined by peripheral faces. It is further provided with a fork-like feature 44, similar in concept to the pair of clamp 20 of the fixing block 18, with a central through hole 46 extending between the upper and lower faces and with a supporting foot 48 arranged opposite to the fork-like 44 feature.

Figure 2:
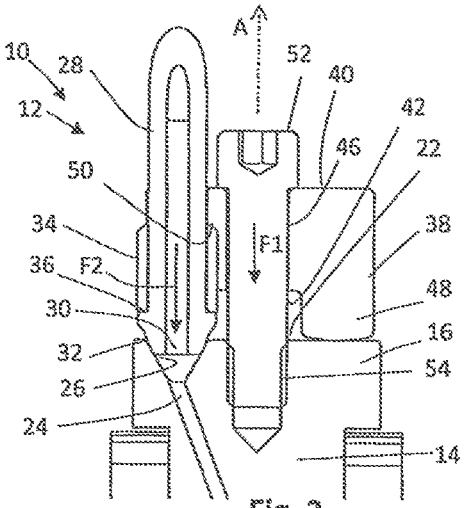
FIG. 2 is a section of the connection of FIG. 1.

In position, the clamping plate's lower face 42 faces the head's top face 22 supported on one side by the foot 48 and on the other side by the sleeve 34 received in the fork-like feature 44 in abutment against a shoulder 50 of said fork-like 44 and, as can be observed on FIG. 2, the sleeve 34 is stuck between the transversal surface 36 and the shoulder 50. To fix the assembly, a screw 52 is engaged in the central through hole 46 and is screwed in a threaded hole 54 provided in the injector's head 16. The screw diameter is chosen upon the size of the injector and the force required to sealingly connect the pipe on the injector. The tightening force F1 generated by the screw 52 pulls the clamping plate 38 toward the injector head's top face 22 and, the fork-like 44 being arranged in cantilever relative to the foot 48 and the screw 52, a force F2 is successively transmitted from the shoulder 50 to the sleeve 34, then to the collar 36, to the male conical surface 32 and finally to the female conical face 26. The two conical surfaces 32, 26 are complementary engaged and sealingly pressed against each other enabling high pressure fuel to flow between the pipe and the injector.

Alternatively, one could arrange the connection without having a sleeve, the clamping plates' fork-like being in direct contact with the pipe's transversal surface and pushing it toward the inlet orifice. Furthermore, in a preferred embodiment the matching surfaces are conical. Other matching surfaces such as portions of spheres, ovoid surfaces or even flat annular rings would similarly provide a sealed connection. A preferred characteristic of these surfaces is that they are surfaces of revolution about an axis that is also the axis of the orifice they are surrounding. Still, as long as the surfaces are matching and can be arranged in complementary manner, a sealingly connection using the teaching of the invention can be implemented. Also, the male-female engagement could be reversed, male in the injector side, female on the pipe side.

Figure 3:
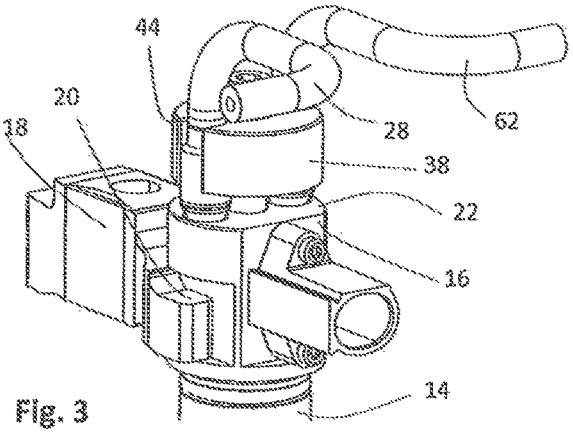
FIG. 3 is similar to FIG. 1, two pipes being connected to the injector.
Figure 4:
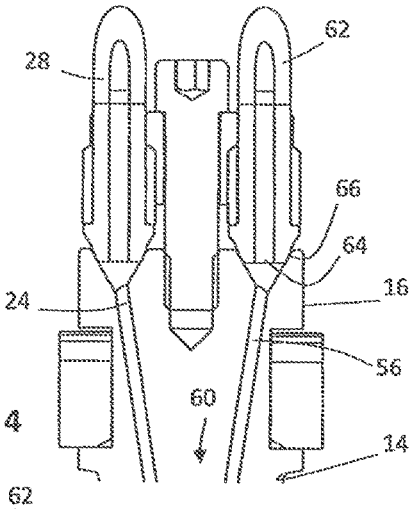
FIG. 4 is a section of the connection of FIG. 3.

A two-pipe alternative of the first embodiment will now be described in reference to FIGS. 3 and 4, focusing on the novel features of said alternative. Similar features having similar roles are given the same reference number.

The injector's head 16 is here further provided with a second orifice 56 similarly shaped to the first orifice 24 with a female conical surface 58 opening at the head's top face 22. Internally to the injector, both orifices join a common volume 60 so that, depending on the need of fuel corresponding to an injection event, the high pressure fuel present in the pipes may enter the injector through both orifices 24, 56. Another pipe 62 provided at its extremity with a matching second orifice 64 surrounded by a male conical surface 66 is sealingly connected to the head's second orifice 56. In this two-pipe alternative the clamping plate 38 has no foot and is now provided with two identical fork-like features 44 symmetrically arranged about the central hole 46. Each fork-like 44 receives a pipe 28, 62, and the central screw 52 sealingly tightens both pipes onto the injector's first 24 and second 56 orifices. All the construction alternatives presented before are of course applicable to this two-pipe arrangement.

Figure 5:
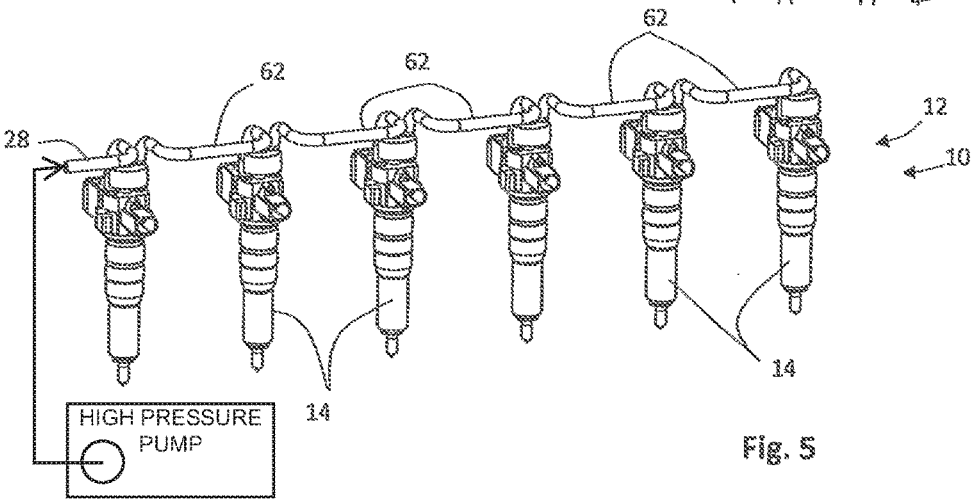
FIG. 5 is a general view of a plurality of injectors connected according to the first embodiment.

As per FIG. 5, the previously described connection systems enable to "daisy chain" multiple injectors. This creates an architecture of fuel injection system where the injectors 14, six in the figure, are connected one after the other. A pipe 28, 62, having matching surfaces at each extremity connects the first orifice 24 of one injector 14 to the second orifice 56 of the neighbor injector. This enables to arrange such system that does not have a large common rail, saving major space in the engine environment.

Figure 6:
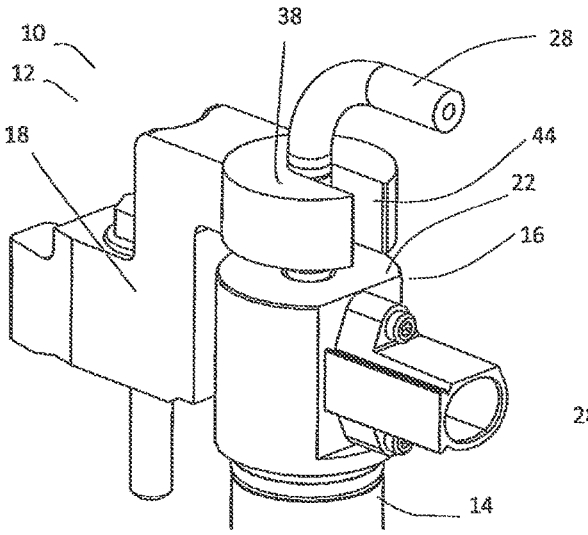
FIG. 6 is a general view of the connection of a pipe on an injector as per a second embodiment.
Figure 7:
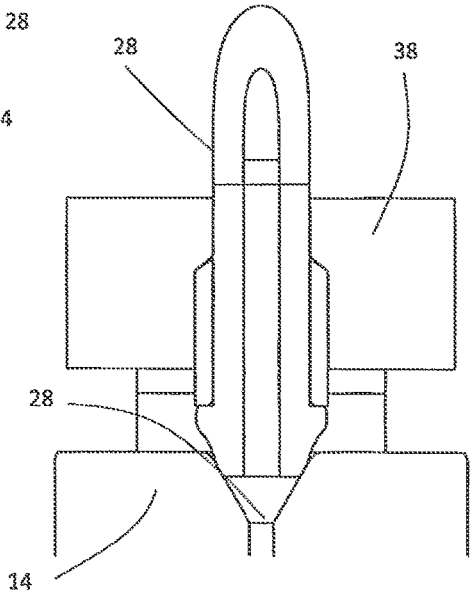
FIG. 7 is a section of the connection of FIG. 6.

A second one-pipe embodiment will now be described in reference to FIGS. 6 and 7. The general principal is similar to the first environment with the difference that an integral "fixing-clamp" replaces the fixing block 18 and the clamping plate 38. The integral fixing-clamp comprises a fixing member, screwed to the engine block, and a clamping member provided with the fork-like feature 44 which receives the pipe 28. The fixing member is arranged as a cantilever relative to the fixing screw so, similarly to the first embodiment, the tightening force generated by the screw is augmented when pressing the pipe onto the first orifice 24. A further advantage of this embodiment is to require one screw only since the force F2 is transmitted to the injector 14 fixing it in place in the well of the engine block.

Figure 8:
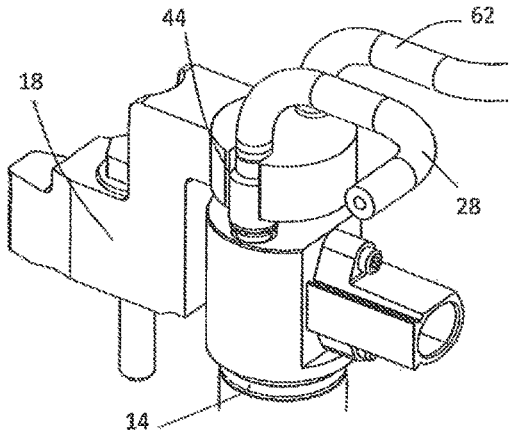
FIG. 8 is similar to FIG. 6, two pipes being connected to the injector.
Figure 9:
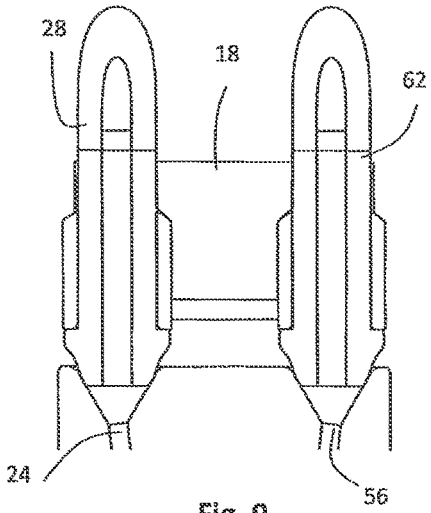
FIG. 9 is a section of the connection of FIG. 8.

A two-pipe alternative of the second embodiment will now be described in reference to FIGS. 8 and 9. The injector 14 is identical to the injector described in the two-pipe alternative of the first embodiment. The integral fixing-clamp is now provided with two fork-like features 44, each one receiving a pipe, one being connected to the injector's first orifice 24, the other being connected to the injector's second orifice 56.

Thanks to the connection system of this two-pipe alternative, a "daisy chain" injection system 12 can be arranged similarly to the system of FIG. 5.

Figure 10:
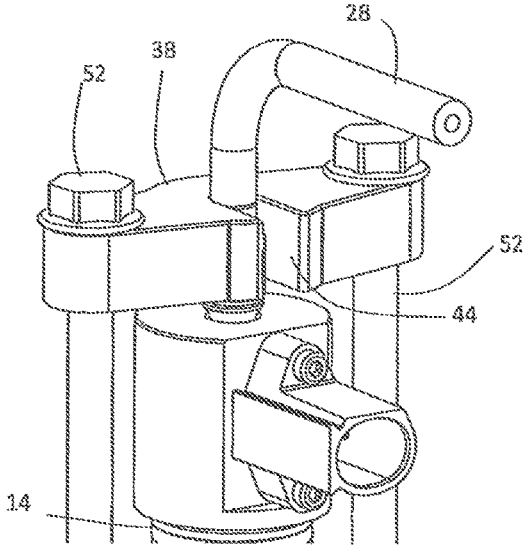
FIG. 10 is a general view of the connection of a pipe on an injector as per a third embodiment.
Figure 11:
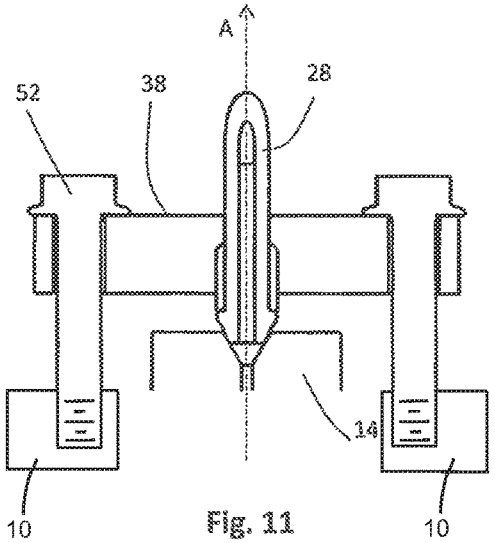
FIG. 11 is a section of the connection of FIG. 10.

A third one-pipe embodiment will now be described in reference to FIGS. 10 and 11. A single pipe 28 is connected on the injector head's first orifice 24 thanks to an elongated clamping plate 38 centrally provided with a fork-like feature 44 for receiving the extremity of said pipe 28. The elongated clamping plate 38 extends beyond the fuel injector 14 and is provided at both its extremities with a through hole 54 wherein is engaged a long screw 52 threaded on the engine block. An advantage of this embodiment is that symmetrical forces are applied on the pipe 28 pressing the matching surfaces against each other. Furthermore, these symmetrical forces are transmitted to the injector 14 that is fixed in place in the well without need of any other part.

Figure 12:
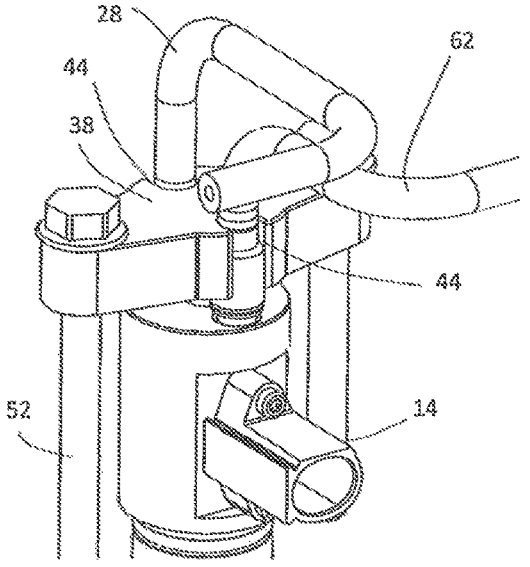
FIG. 12 is similar to FIG. 10, two pipes being connected to the injector.
Figure 13:
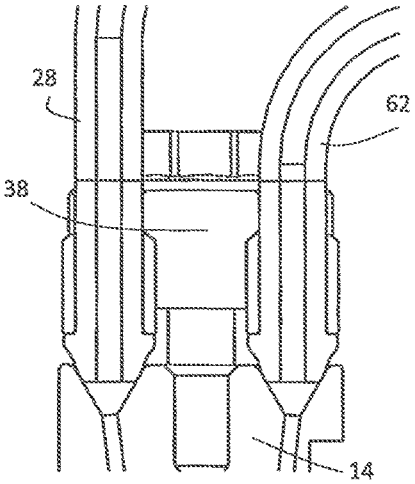
FIG. 13 is a section of the connection of FIG. 12.

A two-pipe alternative to the third embodiment will now be presented in reference to FIGS. 12 and 13. The elongated clamping plate 28 is now provided with two centrally arranged fork-like features 44, each receiving one pipe 28, 62, tightly connected to the first or second orifice of the injector.

Thanks to the connection system of this two-pipe alternative, a "daisy chain" injection system 12 can be arranged similarly to the system of FIG. 5.

Figure 14:
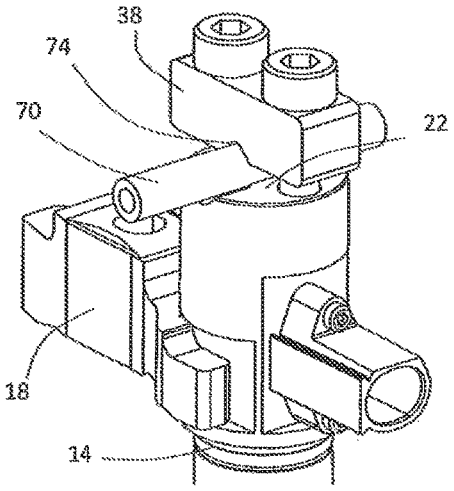
FIG. 14 is a general view of the connection of a pipe on an injector as per a fourth embodiment.
Figure 15:
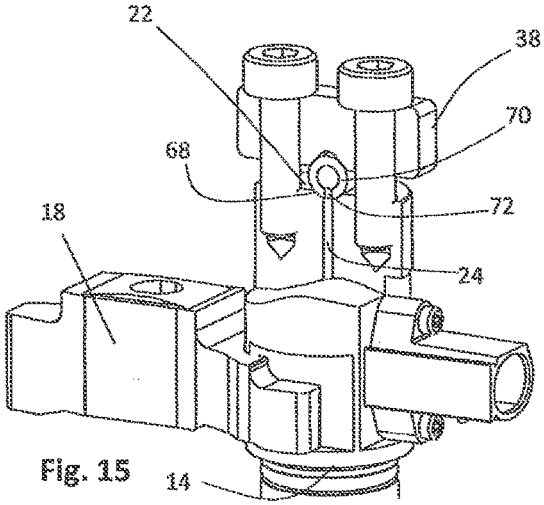
FIG. 15 is a section of the connection of FIG. 14.

A fourth embodiment will now be described in reference to the FIGS. 14 and 15 where the injector 14 is fixed on the engine 10 thanks to the fixing block 18 as it is in the first embodiment.

The injector head's top face 22 is provided with a groove 68, that cross section is an arc of circle which axis is parallel to said top face 22. The surface of the groove 68 is smooth. The first orifice 24 opens at the bottom of the groove 68 where portions of the surface of the groove 68 surround it. A cylindrical pipe 70 which outer diameter is slightly inferior to the diameter of the groove 68 is received in the groove 68 and lies at the bottom of it. The cylindrical pipe 70 is provided with a matching first orifice 72 radially extending through its wall and which is aligned with the first orifice 24 of the injector 14. The pipe 70 is fixed in the groove 68 by the clamping plate 38 that extends over the pipe 70 and that is pulled toward the injector' head 16 by two screws threaded in the injector's head 16. To better hold the pipe 70 in position in the groove 68, the clamping plate 38 receives the pipe 70 in a V-shape notch 74 operated in its lower surface 42, the notch 74 being parallel to the pipe 70. In this arrangement the matching first orifice 72 of the cylindrical pipe 70 is sealingly pressed against the injector's first orifice 24.

One objective to be achieved is to generate in the pipe 70 compressive stresses that offset the stresses generated by the fuel pressure in the tube. To achieve this the shape of the connection of the fourth embodiment may be modified so the groove 68 is quite larger that the diameter of the pipe 70 and, the so called V-notch 74 is also circular and larger than the diameter of the pipe 70. To generate the desired compressive stresses on the pipe 70, the two screws are not parallel to each other, as shown on the figures, but their axes intersect within the injector so the clamp 38 may slightly bend over the pipe 70.

Figure 16:
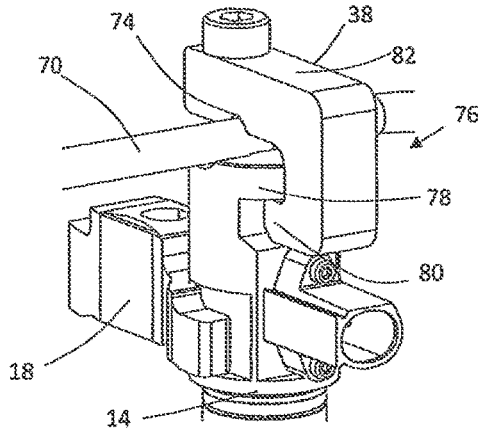
FIG. 16 is a general view of the connection of a pipe on an injector as per a fifth embodiment.
Figure 17:
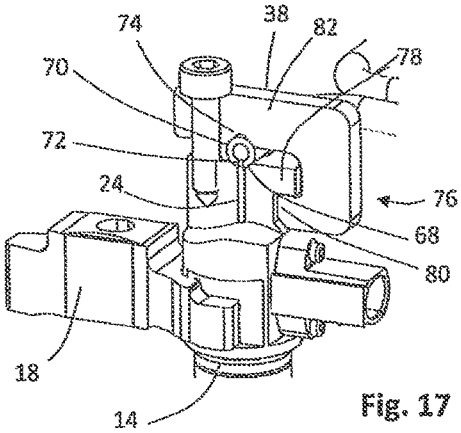
FIG. 17 is a section of the connection of FIG. 16.

An alternative to the fourth embodiment is now described in reference to FIGS. 16 and 17. The main difference of this alternative resides in the clamping feature to press the transversal pipe 70 within the groove 68. The injector's head 16 is now provided with an protrusion member 78 radially extending relative to the main axis A of the injector. The clamping hook 76 has a U-shape, one branch 80 being shorter than the other 82. In position, the short branch 80 is engaged with the protrusion member 78 of the head 16 in a hook-like, so the clamping hook 76 pivots about hook-like and the longer branch 82 of the U lies over the pipe 70. A screw threaded in the injector's head 16 pulls the extremity of the longer branch 82 toward the injector's head 16 and presses the pipe 70 between said longer branch 82 and the groove 68. Here again the longer branch 82 can be provided with a V-shape notch 74 enabling an improved pipe 70 holding. As detailed above, the V-notch has a shaped profile enabling to locate the pipe 70 and to provide appropriate clamping force and stress distribution.

The clamping changes presented above with the non-parallel screws may be implemented as well in this alternative to the fourth embodiment.

Figure 18:
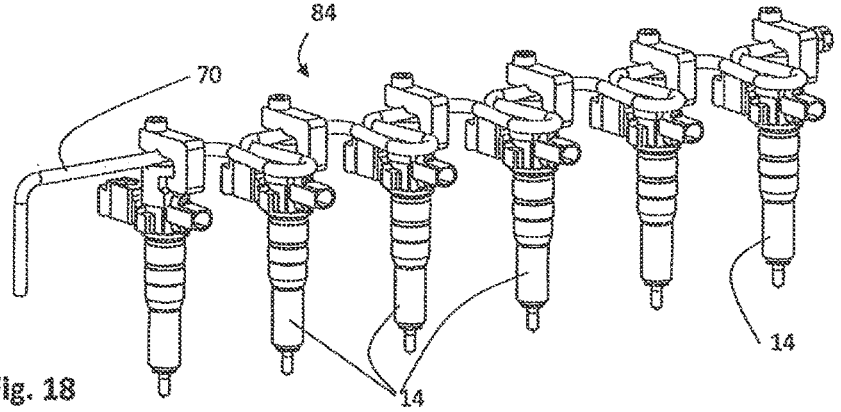
FIG. 18 is a general view of a fuel injection system comprising a plurality of injectors connected to a single pipe.

As presented in FIG. 18, the connection system of the fourth embodiment, and its hook alternative, enables to arrange a system 12 provided with a plurality of injectors 14 connected to a single pipe 70. The single pipe 70 is provided with a plurality of radial orifices 72 through its wall and, each orifice is connected with the first orifice 24 of an injector 14. The pipe 70 can be given a sinuous shape, as in the figure, or any other shape as best required by the engine environment. The advantage of a non-linear shape is to provide a certain flexibility within the pipe 70, elasticity that can enable adjustment on the engine taking into account the cylinder-to-cylinder tolerances.

In yet another alternative, a clamp similar to the clamp 38 of the first embodiment, provided with a leg 48 can be utilized in the last embodiment in replacing the fork-like feature by the V-notch.

Other fuel systems architectures can easily be arranged thanks to the connection systems as presented in the different embodiments of this invention. For instance, the daisy chain or the single pipe can receive fuel from one end or from both ends.

Also, the pumping system barely introduced in this application may comprise a plurality of pumps arranged themselves in parallel or in series.

Also, FIG. 18 presents a "daisy chain" system where the injectors are all connected to a single pipe. An architecture where each injector is connected to the pump through its own pipe, can also be implemented.

The invention claimed is:

1. A fuel injection system for an internal combustion engine, the fuel injection system comprising:

an injector having a first orifice;

a clamping plate; and a pipe tightly connected to said first orifice of said injector, said pipe having a matching first orifice such that said first orifice of said injector is surrounded by a first peripheral smooth surface and said matching first orifice of said pipe is surrounded by a second peripheral smooth surface sealingly pressed against said first peripheral smooth surface by said clamping plate, and wherein said pipe is cylindrical, with said matching first orifice extending radially through said pipe such that said second peripheral smooth surface of said pipe is an outer cylindrical surface of said pipe and said first peripheral smooth surface of said injector is a matching surface of a groove arranged on said injector;

wherein said pipe is engaged between a lower surface of said clamping plate and an upper surface of said injector, and a screw is inserted through said clamping plate and threaded into said injector so that said clamping plate and said injector are pulled toward each other and so that said second peripheral smooth surface of said pipe and said first peripheral smooth surface of said injector are sealingly pressed against each other; and wherein said injector and a first extremity of said clamping plate each have complementary hooks, such that said injector and said first extremity of said clamping plate are engaged via said complementary hooks, said screw being tightened at a second extremity of said clamping plate opposed to said hook of said clamping plate so that said pipe engaged between said lower surface of said clamping plate and said upper surface of said injector is fixed by a radial compression force.

* * * * *